United States Patent [19]

Koppers

[11] 3,983,709

[45] Oct. 5, 1976

[54] ROOF SUPPORT STRUCTURE FOR EXCAVATIONS

[75] Inventor: Manfred Koppers, Duisburg, Germany

[73] Assignee: Rheinstahl AG, Germany

[22] Filed: Oct. 28, 1975

[21] Appl. No.: 626,324

[30] Foreign Application Priority Data

Oct. 31, 1974 Germany ..... 2451747

[52] U.S. Cl. ..... 61/45 D; 248/357

[51] Int. Cl.[2] ..... E21D 15/44

[58] Field of Search ..... 61/45 D; 299/31, 33; 248/357; 91/170 MP

[56] References Cited

UNITED STATES PATENTS 3,830,070 8/1974 Rosenberg et al. ..... 61/45 D

FOREIGN PATENTS OR APPLICATIONS 1,503,990 10/1967 France ..... 61/45 D 1,232,911 1/1965 Germany ..... 61/45 D 156,132 1/1964 U.S.S.R. ..... 61/45 D

*Primary Examiner*—Dennis L. Taylor

*Attorney, Agent, or Firm*—McGlew and Tuttle

[57] ABSTRACT

A roof support structure for excavations comprises a supporting sill beam which is adapted to be anchored in a position below the roof in the shaft or excavation being worked. The sill beam includes a front curved working face forming a closed cover plate and a movable front structure is pivoted on the sill beam at the center of curvature of the cover plate and it has a closed front end plate which is telescopic over the cover plate during pivotal movement. A cave-in shield is pivotaly connected to the outer end of the front structure adjacent the front plate and its opposite end is directed toward the roof and a roof cap structure is pivotally mounted on this end and is positioned against the roof by adjustable hydraulic props which engage against the cave in shield and pivot it to a desired position.

5 Claims, 3 Drawing Figures

ROOF SUPPORT STRUCTURE FOR EXCAVATIONS

BACKGROUND OF THE INVENTION

1. Field of the Invention

This invention relates in general to the construction of devices for shielding excavations such as tunnels and mine shafts and in particular to a new and useful roof support structure which includes a sill beam support and a front structure which is pivotal thereon which form together a telescopically interengageable closed working face and which provide a means for supporting a cave in shield which carries a roof cap.

2. Description of the Prior Art

The present invention deals particularly with the construction of shield-like roof supporting structures in which there is a cave in shield which is coupled to a roof cap so as to support the roof cap against the roof in a mine. The cave in shield is usually mounted so as to extend obliquely and it may be adjusted upwardly and downwardly to position the cap at the desired engagement with the roof so as to be adaptable to various seam thicknesses and the spacing of the support from the face of the workings. One known shield supporting structure of this kind includes a cave in shield which is supported on a sill beam through guide links which insure a lemniscate guidance, and the lever transmission is adjusted as to the length of the levers and pivot point positions so that during adaptation of the supporting shield to the varying seam thicknesses, the hinge point of the cap is guided along a substantially vertical line. The purpose of such an arrangement is to keep the tip of the cap at a constant distance from the base of the excavation such as the coal face in a coal mining operation. The shield supporting structure of the prior art can be vertically adjusted only during its motion in the direction of the coal face, that is while moving away from the fallen end of fragmented roof. In many cases however the broken bits of rock or coal cannot be prevented from immediately following the supporting structure so as to interfere with the operation thereof. With the known structure during the telescoping of the props the guide links swing along with the shield in the direction of the fallen-in area. Since the fragmented rocks or coal keep their contact with the supporting structure, the shield and its links which serve guides are blocked in a disadvantageous manner or at least are hindered in respect to their adjusting motions.

SUMMARY OF THE INVENTION

In accordance with the present invention there is provided a shield-type supporting structure which is provided with operating parts which insure completely satisfactory cooperation between the lemniscate guide links mounted on the sill beam and the cave-in shield even in cases where bits of rock from the roof or the filling waste remains in permanent contact with the supporting structure.

In accordance with the invention the caving side ends of the cave-in shield and the sill beam are designed as front plates which are circularly curved around the lower hinge of the guide link or links associated with the cave-in shield and they include a front structure having a curved front plate which is telescopic in respect to a front closed cover plate of the sill beam. The movable front structure either forms a link by itself or in combination with an extra link which supports the inner end or lower end of the cave-in shield so that adjustable movement of the cave-in shield will cause a corresponding movement of the front structure and insure that the space between the shield and the curved front cover of the sill beam is closed by the movable front structure. In a further advantageous development of the invention the front structure itself which is in the form of a closed hood functions directly as a pivot link connected between a pivot support on the sill beam and a pivot connection to the cave-in shield.

The invention has the substantial advantage that the front plates of the shield and the movable front structure are stiffened by lateral plates which may be structurally formed to withstand the heavy loads of the broken in roof fragments and because of their circular curvature and mutual telescopic engagement permit freedom of movement of the parts and a closing out of the space from contamination by the fallen rock or debris. The supporting structure can be moved toward the coal face and also moved in the direction of the filling area without difficulty. In addition the hood or box-like structure of the sill beam and the movable front structure provides a very strong structure which is resistant to twisting or misalignment. Any tilting or jamming in the hinges is prevented and surface pressures are kept at an optimum low level.

Accordingly it is an object of the invention to provide a roof support structure for excavations which comprises a supporting sill beam which is adapted to be anchored in position below the roof and which has a front curved working face forming a closed cover plate and including a movable front structure having closed side walls which are pivoted on the sill beam substantially at the center of curvature of the cover plate and have a closed curved front plate which is telescopic over the cover plate upon pivoting of the front structure and wherein a cave-in shield has an inner end which is pivotally connected to the side walls of the front structure adjacent the front plate at the end thereof which is remote from the sill beam and wherein the outer end of the cave-in shield is pivotally connected to a cap member which is engageable with the roof structure upon movement of the shield by adjustable props which are connected thereto.

A further object of the invention is to provide a roof support structure which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

GENERAL DESCRIPTION OF THE PREFERRED EMBODIMENT

Figure 1:
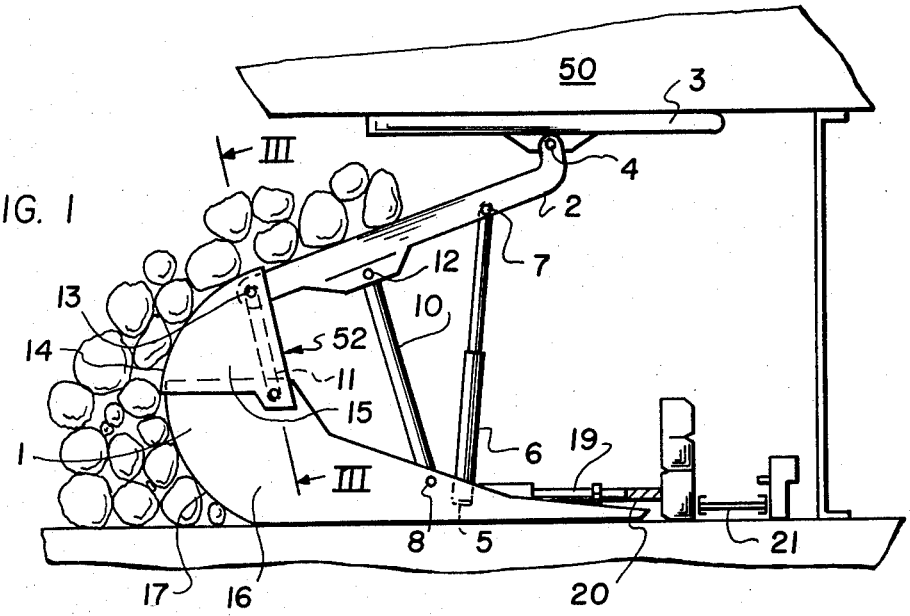
FIG. 1 is a side elevational view of a roof supporting structure constructed in accordance with the invention.

Referring to the drawings in particular the invention embodied therein comprises a roof support structure for excavations such as a coal mine which includes a base member or sill beam 1 which is adapted to be anchored in position below a roof 50 of an excavation such as a mine shaft. A cave-in shield 2 is supported above the sill beam and a cap 3 which is designed as a balance beam is pivoted to the shield 2 at the location of the hinge 4. The shield 2 is partly supported at 7 by a hydraulically operated prop 6 which is mounted at its other end on sill beam 1 and which parts which may be telescopically adjusted in order to vary the angle of inclination of the cave-in shield 2. While a single prop 6 is shown a plurality of such props which are aligned in a row across the width of the shield may be used.

In accordance with the invention a front structure generally designated 52 provides a link connection between the sill beam and the cave-in shield 2 either alone or in conjunction with an additional guide link 11 which is pivoted at its one end at a pivot point 9 on the sill beam and at its opposite end on a pivot member 13 on the cave-in shield 2. The construction also includes one or more guide links 10 arranged across the cave-in shield 2 and articulated at pivots 12 and 8 respectively on the cave-in shield and the sill beam respectively. The linkage is such that during a vertical adjustment of the cave-in shield 2 with its roof cap 3 the front edge of the roof cap 3 moves substantially along a straight line.

Figure 2:
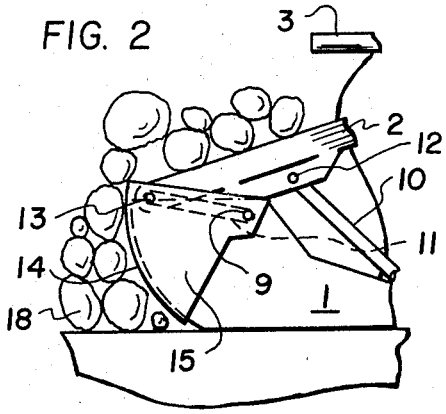
FIG. 2 is a partial view similar to FIG. 1 showing the parts in an opposite end position of operation.
Figure 3:
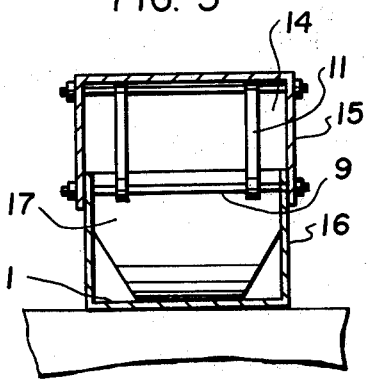
FIG. 3 is a section taken along the line III—III of FIG. 1.

In accordance with a feature of the invention the movable front structure 13 comprises a hood or box formation which includes a curved front plate 14 and two lateral plates 15, 15 which are pivoted at their outer ends at a location on the front structure 52 which is remote from the sill beam 1 to the lower end of the cave-in shield 2. The inner ends of the side plates 15 are pivoted to a pivot member 9 carried by the sill beam. The pivot member 9 is at a center of curvature of a front wall forming a cover plate 17 of the sill beam and which is curved in a manner similar to the curved front wall 14. The construction is such that the front structure 52 will telescope over the working end or front face of the sill beam 1. Both the front plate 14 and the cover plate 17 are made of a strong material and are curved about a radius having its center at the hinge 9. Because of the fact that the front plate 14 of the shield 2 engages over the cover plate 17 during the movement from the position shown in FIG. 1 to the position shown in FIG. 2 there is no possibility that any debris or rock structure will enter into the space between the operating parts, and a free motion of the shield 2 is insured.

The hood formed by the front structure 52 may also be rigidly connected to the cave-in shield 2 and without the use of the guide link 11. In such an embodiment the high stiffness of the shield 2 against torsional forces is obtained.

The sill beam 1 is anchored in the shaft and it includes shifting cylinders 19 which engage against an abutment beam 20 which extends in the dip heading and applies in turn against the rear side of a long wall conveyor 21.

While a specific embodiment of the invention has been shown and described in detail to illustrate the application of the principles of the invention, it will be understood that the invention may be embodied otherwise without departing from such principles.

What is claimed is:

1. A roof support structure for excavations comprising a supporting sill beam adapted to be anchored in position below the roof and having a front curved working face forming a closed cover plate, a movable front structure having closed side walls pivoted on said sill beam substantially at the center of curvature of said cover plate and having a closed curved front wall telescopic over said cover plate upon pivoting of said front structure, a cave-in shield having an inner end pivotally connected to said front structure on said side walls adjacent said front plate at the end thereof which is remote from said sill beam, said cave-in shield having an outer end extending toward the roof, and a cap member pivotally mounted on said cave-in shield adjacent the outer end thereof and adapted to be held against the roof by said cave-in shield, and shifting means engageable with said cave-in shield to pivot it selectively toward and away from said roof.

2. A roof support structure according to claim 1, wherein said front structure curved front plate has substantially the same radius of curvature as the front curved working face of said closed cover plate of said sill beam, said front structure having reinforced side walls and forming a substantially U-shaped hood.

3. A roof support structure according to claim 1, wherein said shifting means includes a hydraulic prop carried by said sill beam and having an upper end engaged with said cave-in shield.

4. A roof support structure according to claim 1, including a shift cylinder carried on said sill, said shift cylinder being engageable with an abutment beam and having a telescopically extensible portion.

5. A shield according to claim 1, wherein said front structure provides a first link connection between the end of said cave-in shield and said sill beam and including a second link connection between said sill beam and said cave-in shield at a location intermediate the length of said cave-in shield.

* * * * *